US006884023B2

(12) United States Patent
Dube et al.

(10) Patent No.: US 6,884,023 B2
(45) Date of Patent: Apr. 26, 2005

(54) INTEGRAL SWIRL KNIFE EDGE INJECTION ASSEMBLY

(75) Inventors: Bryan Dube, Columbia, CT (US); Andrew D. Milliken, Middletown, CT (US); John H. Mosley, Portland, CT (US); Conan Cook, Norwich, VT (US)

(73) Assignee: United Technologies Corporation, Hartford, CT (US)

( * ) Notice: Subject to any disclaimer, the term of this patent is extended or adjusted under 35 U.S.C. 154(b) by 11 days.

(21) Appl. No.: 10/260,083

(22) Filed: Sep. 27, 2002

(65) Prior Publication Data

US 2004/0062637 A1 Apr. 1, 2004

(51) Int. Cl.[7] ..... F04D 31/00

(52) U.S. Cl. ..... 415/116; 415/115; 415/117; 415/173.5; 415/174.5

(58) Field of Search ..... 415/115, 116, 415/117, 180, 173.5, 174.5, 230; 416/96 A, 97 R

(56) References Cited

U.S. PATENT DOCUMENTS

| | | | | | |
|---|---|---|---|---|---|
| 2,738,949 | A | * | 3/1956 | Wilkinson | 415/115 |
| 2,919,891 | A | * | 1/1960 | Olover | 415/180 |
| 3,411,794 | A | * | 11/1968 | Allen | 415/174.5 |
| 3,945,758 | A | * | 3/1976 | Lee | 415/115 |
| 4,113,406 | A | * | 9/1978 | Lee et al. | 415/115 |
| 5,352,087 | A | * | 10/1994 | Antonellis | 415/115 |
| 5,488,825 | A | * | 2/1996 | Davis et al. | 60/806 |
| 5,785,492 | A | | 7/1998 | Belsom et al. | |
| 5,997,245 | A | * | 12/1999 | Tomita et al. | 415/115 |
| 6,065,928 | A | * | 5/2000 | Rieck et al. | 415/115 |
| 6,077,034 | A | * | 6/2000 | Tomita et al. | 415/115 |
| 6,099,244 | A | * | 8/2000 | Tomita et al. | 415/115 |
| 6,142,730 | A | * | 11/2000 | Tomita et al. | 415/115 |
| 6,217,279 | B1 | * | 4/2001 | Ai et al. | 415/110 |
| 6,357,999 | B1 | * | 3/2002 | Pearce et al. | 415/115 |
| 6,398,485 | B1 | * | 6/2002 | Frosini et al. | 415/115 |
| 6,431,824 | B1 | * | 8/2002 | Schotsch et al. | 415/115 |

FOREIGN PATENT DOCUMENTS

| | | | | |
|---|---|---|---|---|
| EP | 0 911 489 A1 | | 4/1999 | 415/115 |
| EP | 0 919 700 A1 | | 6/1999 | 415/115 |
| EP | 0 864 728 A3 | | 5/2000 | 415/115 |
| EP | 1 057 974 A3 | | 1/2004 | 415/115 |
| GB | 1 282 142 | | 7/1972 | |
| GB | 2010404 A | * | 6/1979 | 415/117 |
| JP | 10-317908 | | 12/1998 | F01D/9/04 |
| JP | 11-30104 | | 2/1999 | F01D/9/04 |

* cited by examiner

*Primary Examiner*—Thai-Ba Trieu
(74) *Attorney, Agent, or Firm*—Bachman & LaPointe, P.C.

(57) ABSTRACT

The present invention relates to a system for delivering cooling air to a seal arrangement in a turbine stage of a gas turbine engine. The system comprises at least one vane having a passageway extending from an outer platform of the at least one vane to an inner platform of the at least one vane. A tube insert is positioned within the passageway. The tube insert has an inlet at one end for receiving cooling air from a source of cooling air and an outlet at a second end. A cover assembly is attached to the second end of the tube for receiving cooling air from the tube and delivering the cooling air to the seal arrangement. In a preferred embodiment, the cooling air is pre-swirled in the direction of rotation of a rotor stage of the turbine stage.

18 Claims, 6 Drawing Sheets

INTEGRAL SWIRL KNIFE EDGE INJECTION ASSEMBLY

BACKGROUND OF THE INVENTION

The present invention relates to a system for delivering cooling air to a seal arrangement in a turbine stage of a gas turbine engine.

Many gas turbine engines have a second stage turbine stator vane assembly disposed between rotors. The stator vane assembly includes a plurality of stator vane segments collectively forming an annular structure. A seal ring, located radially inside of the inner platforms of the stator vane segments, is used to maintain a pressure difference between a first annular region adjacent the first stage rotor and a second annular region adjacent the second stage rotor. The seal ring includes an outer flange and an inner flange. The outer flange includes splines to prevent rotation and an abradable bearing pad. A honeycomb pad is attached to the inner flange for use with knife edge seals. The splines disposed in the outer flange are slidably received, in an axial direction, within inner mounting flanges extending below the inner platforms. Hooks, extending out from the outer flange, limit the axial travel of the seal ring relative to the inner mounting flanges. The pressure difference between the first annular region adjacent the first rotor stage and the second annular region adjacent the second stage rotor forces the abradable bearing pad of the seal ring into contact with the aft arm of the inner mounting flanges. Such a seal arrangement is shown in U.S. Pat. No. 5,785,492 to Belsom et al., which is hereby incorporated by reference herein.

In certain turbines, the rotor seals have a life shortfall. This is because a vane is used to supply cooling air to the cavity adjacent the high pressure turbine gaspath, where cooling flow rate and temperature drive the seal life. The cooling air travels through the vane before reaching the seal rim cavity. Gaspath air heats the vane and the cooling air passing through the vane. If the cooling air temperature is too high, the seal assembly does not meet design life intent.

Thus, there is a need for a more efficient approach for delivering cooling air to the seal rim cavity.

SUMMARY OF THE INVENTION

Accordingly, it is an object of the present invention to provide a system for providing cooling air to a seal arrangement with as little heat-up of the cooling air through the vane as possible.

It is also an object of the present invention to provide a system as above which pre-swirls the cooling air in the direction of rotation of a rotor stage so as to reduce heat-up due to windage.

The foregoing objects are attained by the system of the present invention.

In accordance with the present invention, a system is provided for delivering cooling air to a seal arrangement in a turbine stage of a gas turbine engine. The system broadly comprises at least one vane in said turbine stage having a cooling passageway extending from an outer platform of the at least one vane to an inner platform of the at least one vane and means for delivering cooling air to the seal arrangement. The delivering means comprises a tube insert positioned within the cooling passageway. The tube insert has an inlet at one end for receiving cooling air from a source of cooling air and an outlet at a second end. The delivering means further comprises cover means attached to the second end of the tube insert for receiving cooling air from the tube insert and delivering the cooling air to the seal arrangement. Preferably, the cover means delivers the cooling air to the seal arrangement in a pre-swirled manner in the direction of rotation of a turbine rotor of the gas turbine engine.

Other details of the integral swirl knife edge injection assembly of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
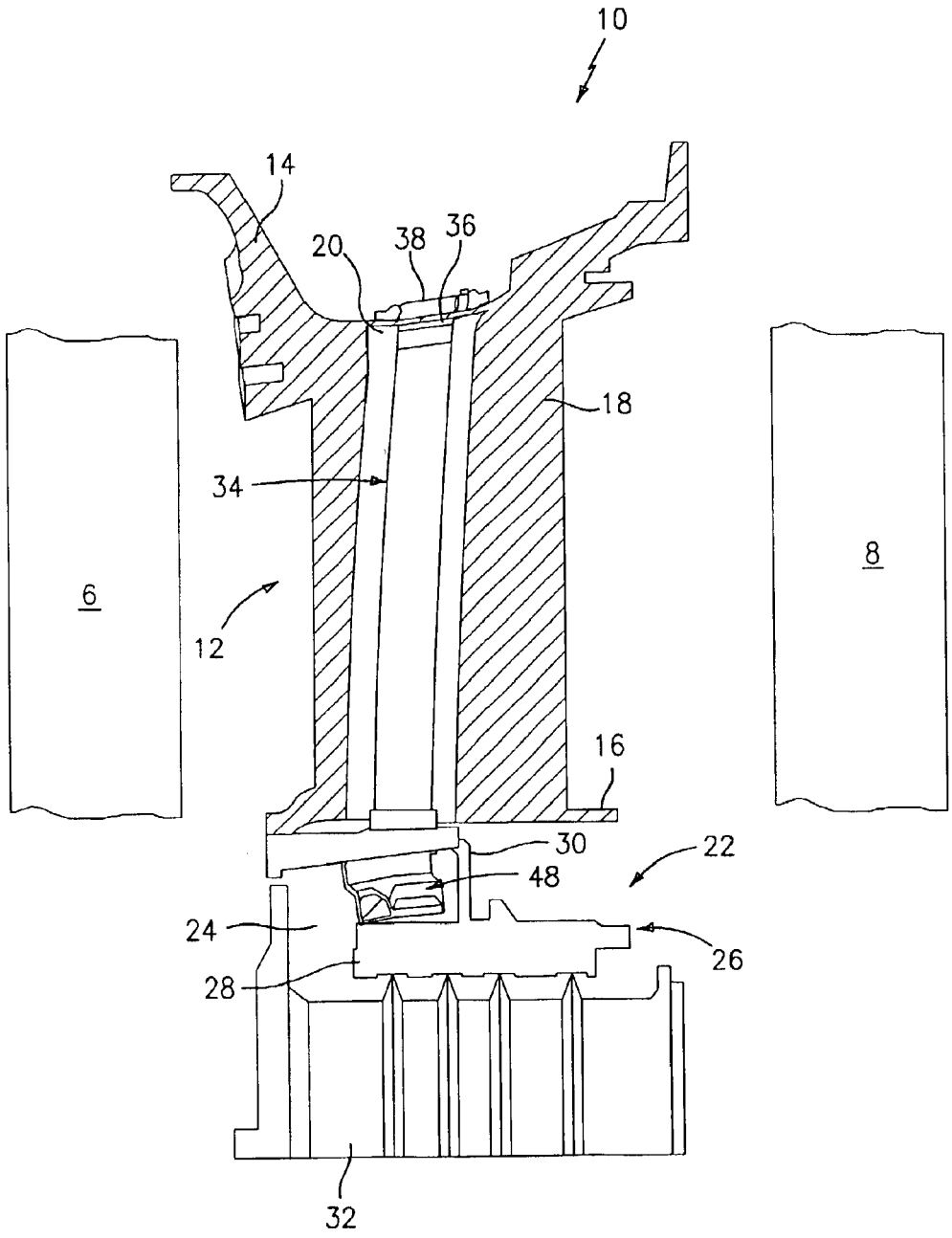
FIG. 1 is a diagrammatic view of a second stage turbine stator vane assembly in partial cross section disposed aft of a first stage turbine rotor and forward of a second stage turbine rotor.

Referring now to the drawings, FIG. 1 illustrates a second stage turbine vane assembly 10 disposed aft of a first stage turbine rotor 6 and forward of a second stage turbine rotor 8. (While the present invention will be described in the context of first and second stage rotors, the knife edge injection assembly of the present invention may be used between other turbine rotor stages.) The turbine vane assembly 10 includes a plurality of stator vanes 12. Each of the stator vanes 12 has an outer platform 14, an inner platform 16, and an airfoil portion 18 extending between the outer and inner platforms 14 and 16. Each of the stator vanes 12 has a passageway 20 which extends through the vane from the outer platform 14 to the inner platform 16. The passageway 20 is a cooling passageway used to cool the interior of the vane 12.

The assembly 10 further has a knife edge seal assembly 22 for maintaining a pressure difference between a first annular region or seal rim cavity 24 adjacent the first stage rotor and a second annular region 26 adjacent the second stage rotor. The seal assembly 22 includes a honeycomb pad 28 attached to an inner flange 30. A plurality of knife-edge seals 32 disposed to contact the honeycomb pad 28 and form a seal between the two regions 24 and 26. In order to extend the life of the seal assembly 22, it is necessary to deliver cooling air to the seal rim cavity 24 and the knife edge seals 32.

Figure 4:
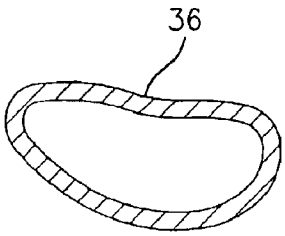
FIG. 4 is a sectional view of a tube insert used in the cooling air delivery system of FIG. 2 taken along lines 4—4 in FIG. 2.

To accomplish the goal of delivering cooling air to the region 24 and the knife edge seals 32, a cooling air delivery system 34 is incorporated into each vane 12 of the assembly 10. The cooling air delivery system 34 includes a tube insert 36 disposed within the cooling passageway 20. As can be seen from FIGS. 2 and 3, the tube insert 36 is non-linear and has an inlet end 38 and an outlet end 40. The tube insert 36 also has sidewalls 37 which are spaced from the sidewalls 35 of the passageway 20. In operation, cooling air from a source (not shown), such as a compressor stage of a gas turbine engine, is introduced into cooling passageway 20 and simultaneously into the inlet end 38 of the tube insert 36. The tube insert 36 may be formed from any suitable metallic material known in the art such as Inconel 625. As can be seen from FIG. 4, the tube insert 36 has a flattened, non-circular cross sectional shape.

Figure 5:
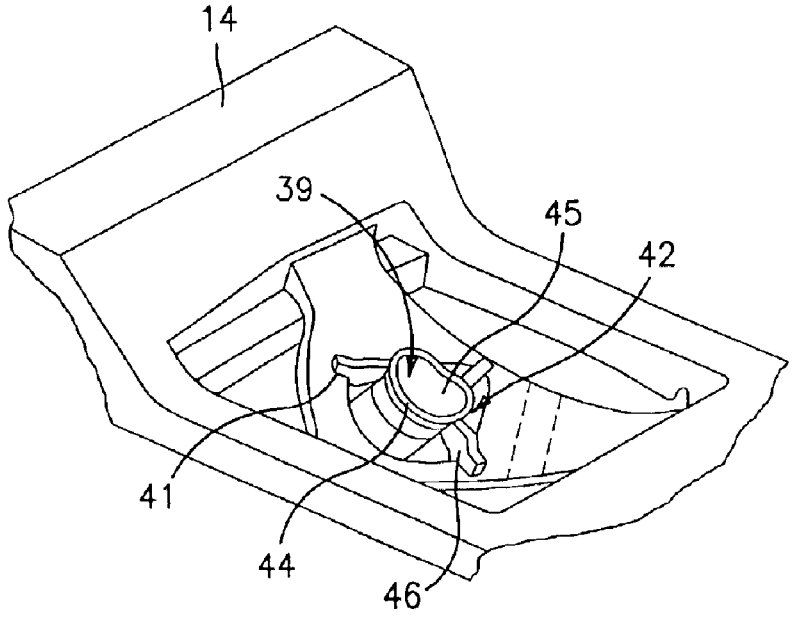
FIG. 5 is a perspective view of a retainer assembly used in the cooling air delivery system of FIG. 2.
Figure 7:
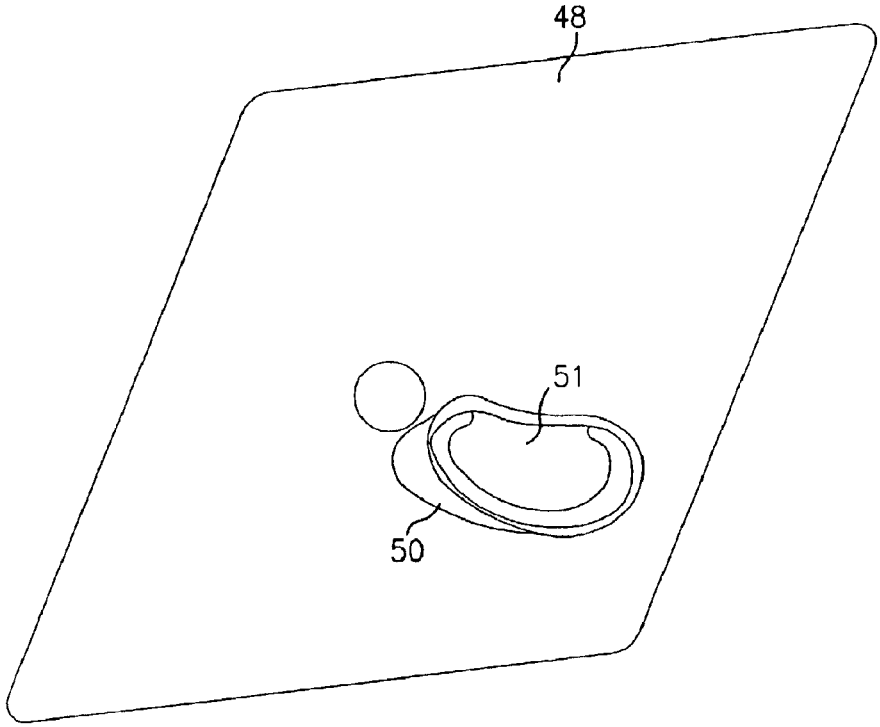
FIG. 7 is a top view of the cover assembly of FIG. 6.
Figure 6:
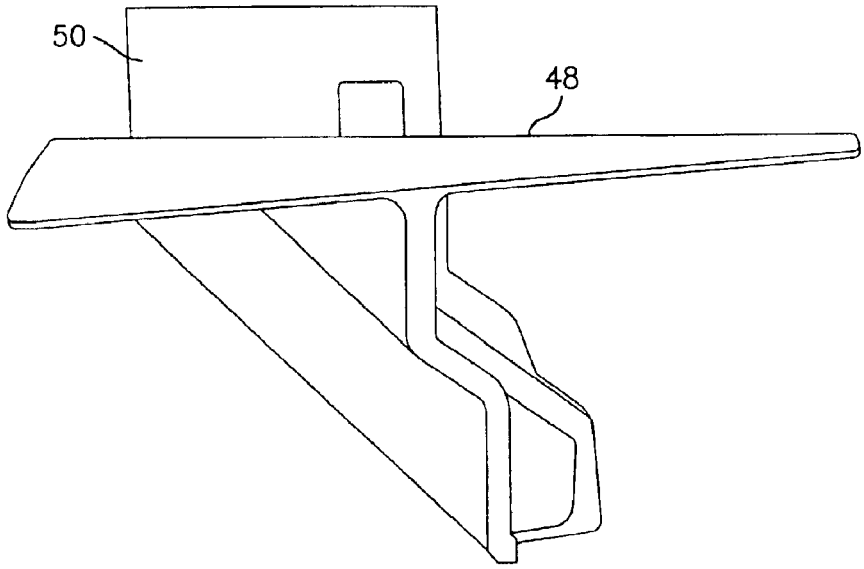
FIG. 6 is an end view of a cover assembly used in the cooling air delivery system of FIG. 2.

As shown in FIG. 5, a retainer 39 is placed over the inlet end 38 of the tube insert 36 and is used to retain the inlet end 38 of the tube insert 36 in position with respect to an inlet 42 of the cooling passageway 20. The retainer 39 has a central portion 44 which fits over and receives the inlet end 38 of the tube insert 36 and a plurality of legs 46 extending from the central portion 44. The central portion 44 has an internal opening 45 with a non-circular, flattened shape corresponding to the shape of the tube insert 36. In a preferred embodiment of the present invention, the tube insert 36 is welded to the retainer 39 or fastened to the retainer 39 by a braze material. To maintain the retainer 39 in position, the legs 46 are positioned on a fillet weld 41 which extends across the inlet 42 to the cooling passageway 20. If desired, each of the legs 46 may be affixed to the fillet weld using any suitable means known in the art.

Figure 2:
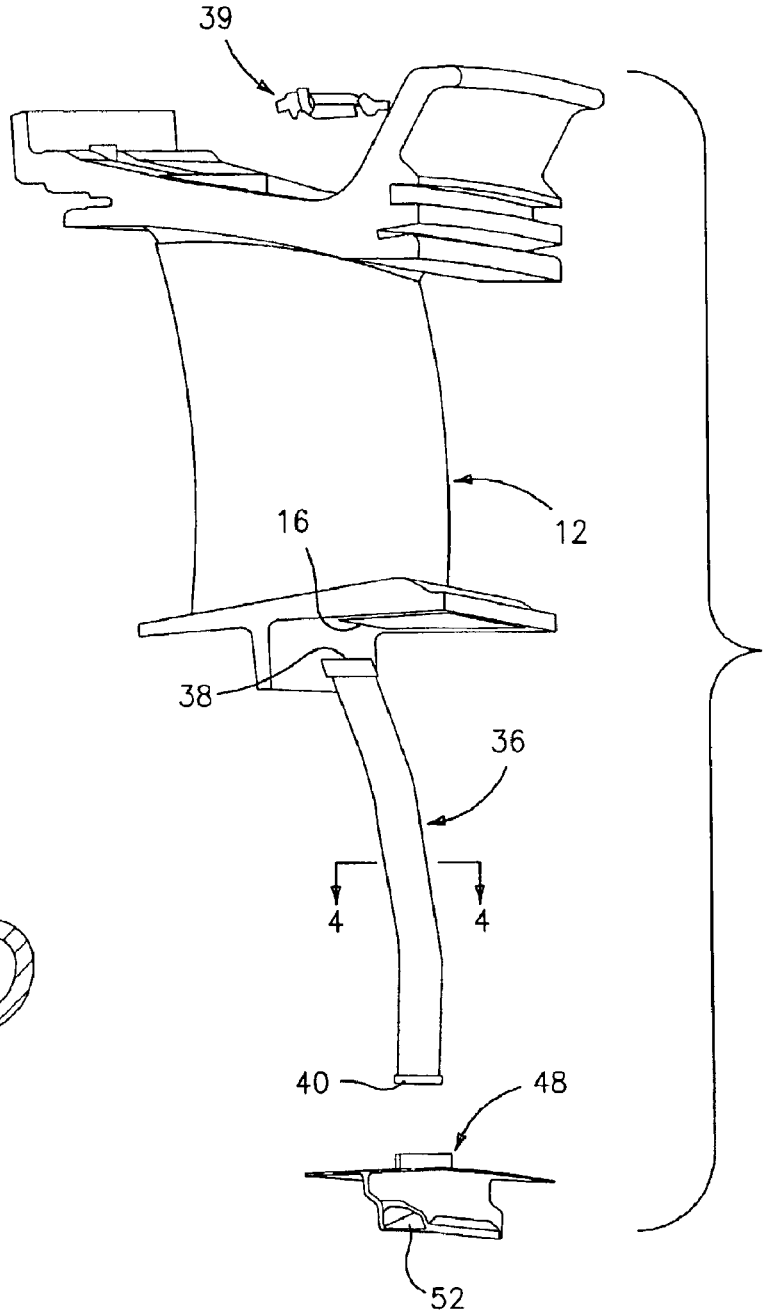
FIG. 2 is an exploded view of a system for delivering cooling air to the seal arrangement shown in FIG. 1.
Figure 3:
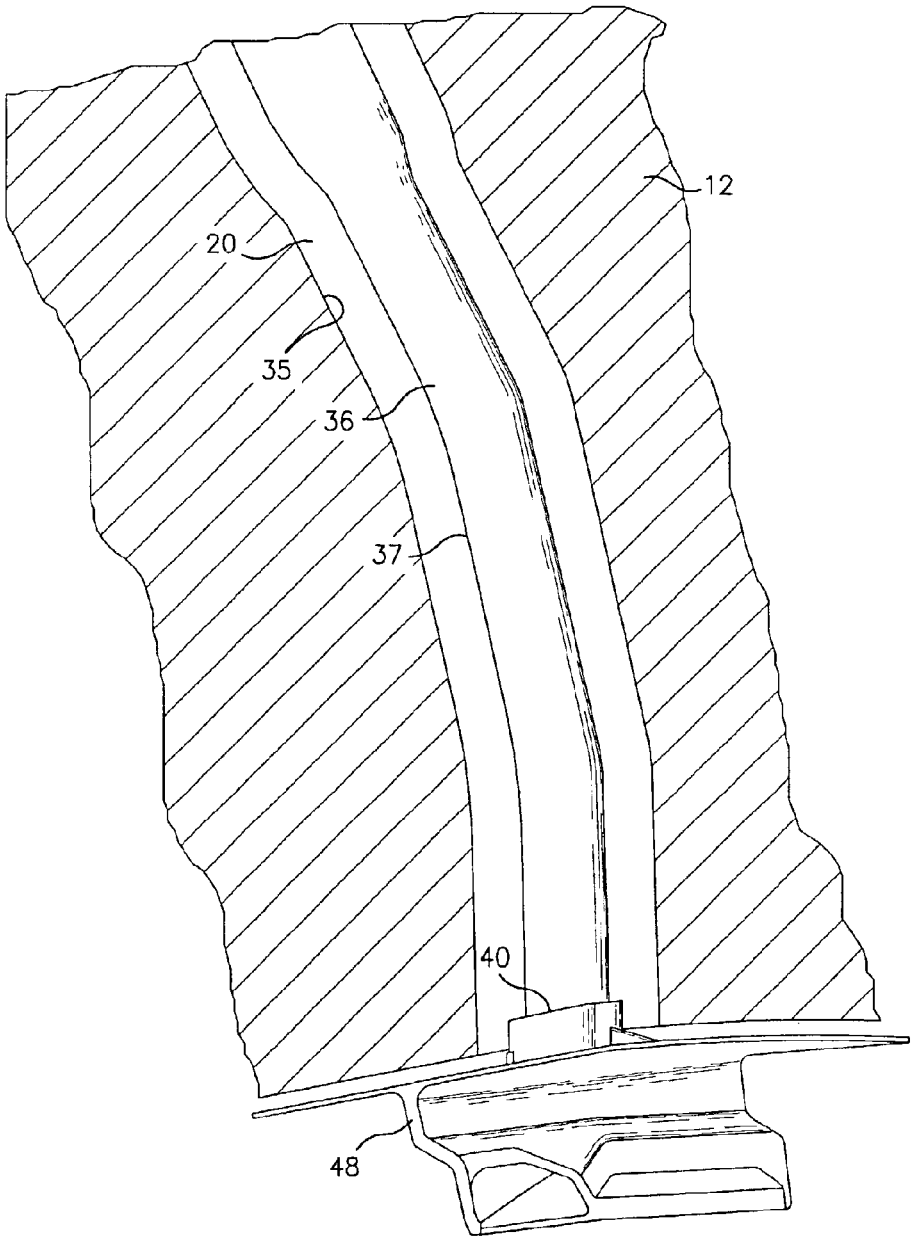
FIG. 3 is an enlarged view of a portion of the system for delivering cooling air to a seal rim cavity of the turbine stator vane assembly of FIG. 1.
Figure 8:
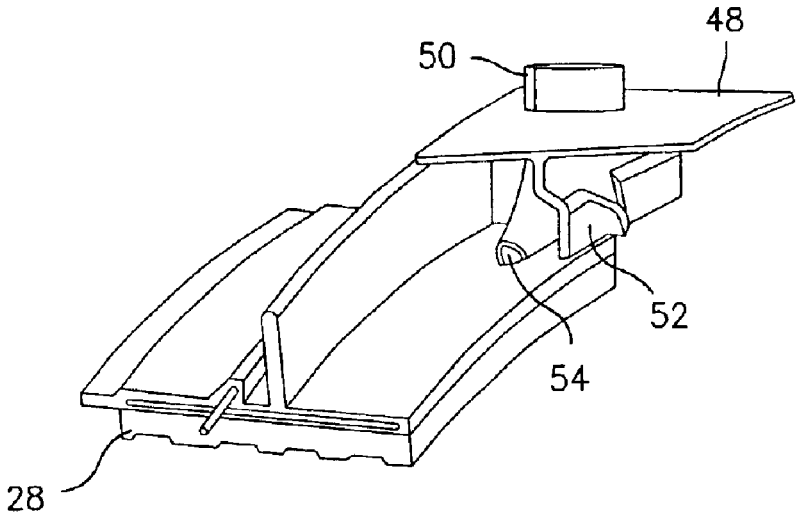
FIG. 8 is a perspective view showing a nozzle portion of an alternative cover assembly penetrating through a honeycomb pad portion of the seal arrangement.
Figure 9:
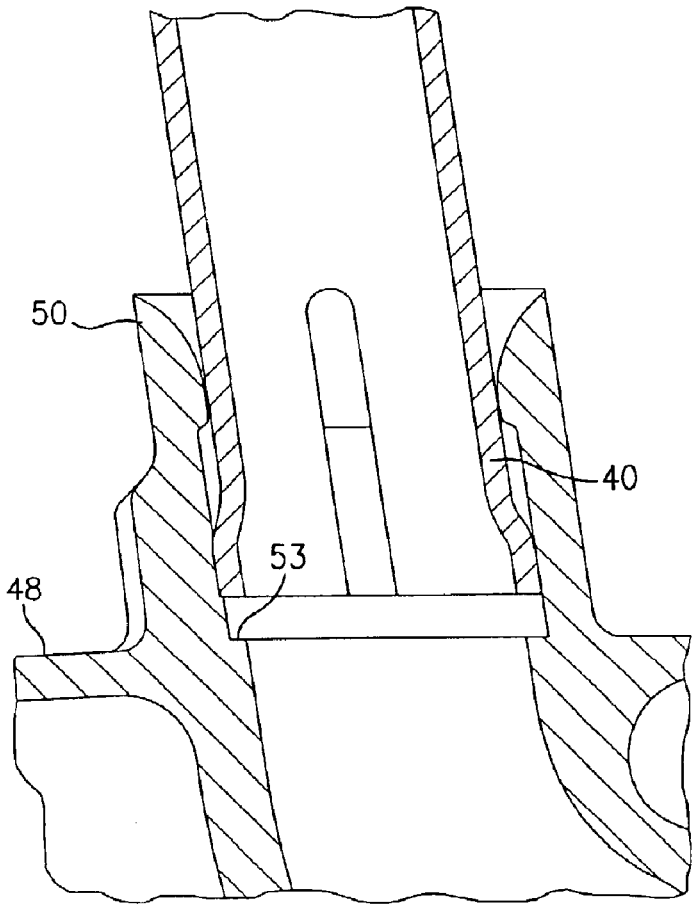
FIG. 9 is a sectional view of a portion of the cover assembly of FIG. 6.

Referring now to FIGS. 2 and 6–9, a cover assembly 48 is joined to the outlet end 40 of the tube insert 36. The cover assembly 48 includes a raised collar portion 50 which receives and frictionally engages the outlet end 40 of the tube insert 36. As can be seen from FIG. 7, the collar portion 50 has an interior opening 51 which has a non-circular, flattened shape which corresponds to the cross sectional shape of the tube insert 36. As shown in FIG. 9, the collar portion 50 can be provided with a shoulder 53 which contacts the outlet end 40 of the tube insert 36 so that the tube insert 36 may be snap fit therein. The cover assembly 48 may have a single fluid exit 52, as shown in FIG. 2, in fluid communication with the outlet end 40 of the tube insert 36 via an internal passageway (not shown) or may have two fluid exits 52 and 54, as shown in FIG. 8, which are in fluid communication with the outlet end 40 of the tube insert 36 via an internal passageway (not shown). The first fluid exit 52 comprises a nozzle which may be placed into an opening in the honeycomb pad 28 to deliver cooling air between two of the knife edge seals 32, such as between the two knife edge seals closest to the seal rim cavity 24. When present, the second fluid exit 54 comprises an opening in the cover assembly 48 which delivers cooling air to the seal rim cavity 24. In a preferred embodiment of the present invention, the exits 52 and/or 54 are configured so as to deliver cooling air to the seal rim cavity 24 and/or the space between the two knife-edge seals so that it is pre-swirled in the direction of rotation of the first turbine rotor stage. This is desirable to reduce heat-up due to windage.

The retainer 39 and the cover assembly 48 may be formed from any suitable metallic material known in the art. For example, if desired, each of these components could be formed from Inconel 625.

One of the advantages to the cooling air delivery system of the present invention is that cooling air can be delivered with little heat-up as a result of the passage of the cooling air through the vane 12. This is because the tube insert 36 acts as a heat shield between the cooling air and the vane 12. Still further, the tube insert 36 accelerates the cooling air as it passes through the vane 12, thus reducing exposure time to heat.

Another advantage to the system of the present invention is that it does not interfere with the internal cooling of the vane 12 by the cooling passageway 20.

It is apparent that there has been provided in accordance with the present invention an integral swirl knife edge injection tube assembly which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A cooling system for a vane comprising:

a vane cooling passageway extending from an outer platform of the vane to an inner platform of the vane for cooling internal portions of the vane;

means for delivering cooling air to a knife edge seal arrangement, said cooling air delivering means including a tube insert positioned within said vane cooling passageway; and said tube insert having an outlet end and a cover assembly attached to said outlet end for providing cooling air to the seal arrangement, said cover assembly having means for receiving cooling air from said tube insert and means for delivering said cooling air to said seal arrangement.

2. A cooling system according to claim 1, further comprising said tube insert having an inlet end; and means attached to said inlet end for positioning said tube insert relative to an inlet end of said cooling passageway.

3. A system for delivering cooling air to a knife edge seal arrangement in a turbine stage of a gas turbine engine comprising:

at least one vane of said turbine stage having a passageway extending from an outer platform of said at least one vane to an inner platform of said at least one vane;

means for delivering cooling air to said seal arrangement;

said delivering means comprises a tube insert positioned within said passageway;

said tube insert having an inlet at one end for receiving cooling air and an outlet at a second end; and said delivering means further comprising cover means attached to said second end of said tube insert, said cover means having means for receiving cooling air from said tube insert and means for delivering said cooling air to said seal arrangement.

4. A system for delivering cooling air to a knife edge seal arrangement in a turbine stage of a gas turbine engine comprising:

at least one vane of said turbine stage having a passageway extending from an outer platform of said at least one vane to an inner platform of said at least one vane;

means for delivering cooling air to said seal arrangement;

said delivering means comprising a tube insert positioned within said passageway;

said tube insert having an inlet at one end for receiving cooling air and an outlet at a second end;

said delivering means further comprising cover means attached to said second end of said tube insert for receiving cooling air from said tube insert and delivering said cooling air to said seal arrangement; and said cover means having means for providing said cooling air to said seal arrangement in a pre-swirled manner in a direction of rotation of a turbine rotor stage of said turbine engine.

5. A system according to claim 4, wherein said cover means has nozzle means for providing cooling air to a seal rim cavity.

6. A system according to claim 4, wherein said seal arrangement includes a honeycomb pad and a plurality of knife edge seals in contact with said honeycomb pad and said means for providing said cooling air comprising a first nozzle which extends through said honeycomb pad into a space between two of said knife edge seals.

7. A system according to claim 4, wherein said delivering means further comprises means affixed to said inlet end of said tube insert for retaining said tube insert in position with respect to said passageway.

8. A system according to claim 4, wherein said tube insert is non-linear and has a flattened, non-circular cross sectional shape.

9. A system according to claim 4, wherein said at least one vane comprises at least one stator vane.

10. A system according to claim 4, wherein said turbine stage has a plurality of vanes and each of said vanes includes said cooling air delivering means.

11. A system according to claim 4, wherein said insert tube has sidewalls spaced from sidewalls of said passageway.

12. A system according to claim 4, wherein said passageway is an internal vane cooling passageway.

13. A system for delivering cooling air to a knife edge seal arrangement in a turbine stage of a gas turbine engine comprising:

at least one vane of said turbine stage having a passageway extending from an outer platform of said at least one vane to an inner platform of said at least one vane;

means for delivering cooling air to said seal arrangement;

said delivering means comprises a tube insert positioned within said passageway;

said tube insert having an inlet at one end for receiving cooling air and an outlet at a second end;

said delivering means further comprising cover means attached to said second end of said tube insert for receiving cooling air from said tube insert and delivering said cooling air to said seal arrangement;

said cover means having means for providing said cooling air to said seal arrangement in a pre-swirled manner in a direction of rotation of a turbine rotor stage of said turbine engine;

said seal arrangement including a honeycomb pad and a plurality of knife edge seals in contact with said honeycomb pad and said means for providing said cooling air comprising a first nozzle which extends through said honeycomb pad into a space between two of said knife edge seals; and said cooling air providing means further comprising a second nozzle for providing cooling air to a seal rim cavity.

14. A system for delivering cooling air to a knife edge seal arrangement in a turbine stage of a gas turbine engine comprising:

at least one vane of said turbine stage having a passageway extending from an outer platform of said at least one vane to an inner platform of said at least one vane;

means for delivering cooling air to said seal arrangement;

said delivering means comprises a tube insert positioned within said passageway;

said tube insert having an inlet at one end for receiving cooling air and an outlet at a second end;

said delivering means further comprising cover means attached to said second end of said tube insert for receiving cooling air from said tube insert and delivering said cooling air to said seal arrangement; and said cover means having a collar protruding from one side and said collar surrounding said outlet end of said tube insert.

15. A system according to claim 14, wherein said collar has an interior portion with a shape corresponding to the cross sectional shape of said tube insert.

16. A system for delivering cooling air to a knife edge seal arrangement in a turbine stage of a gas turbine engine comprising:

at least one vane of said turbine stage having a passageway extending from an outer platform of said at least one vane to an inner platform of said at least one vane;

means for delivering cooling air to said seal arrangement;

said delivering means comprises a tube insert positioned within said passageway;

said tube insert having an inlet at one end for receiving cooling air and an outlet at a second end;

said delivering means further comprising cover means attached to said second end of said tube insert for receiving cooling air from said tube insert and delivering said cooling air to said seal arrangement;

said delivering means further comprising means affixed to said inlet end of said tube insert for retaining said tube insert in position with respect to said passageway; and said retaining means having a central portion configured to fit over the inlet end of said tube insert and a plurality of retainer legs affixed to said central portion.

17. A system according to claim 16, wherein said central portion is welded to said inlet end of said tube insert.

18. A system according to claim 16, wherein said central portion is joined to said inlet end of said tube insert by a braze material.

* * * * *